US011305324B2

(12) United States Patent
Barton

(10) Patent No.: US 11,305,324 B2
(45) Date of Patent: Apr. 19, 2022

(54) GEARED CONDUIT BENDER

(71) Applicant: Milwaukee Electric Tool Corporation

(72) Inventor: George Barton, Mequon, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/829,853

(22) Filed: Mar. 25, 2020

(65) Prior Publication Data

US 2020/0222963 A1 Jul. 16, 2020

Related U.S. Application Data

(63) Continuation of application No. PCT/US2018/052428, filed on Sep. 24, 2018.

(60) Provisional application No. 62/569,087, filed on Oct. 6, 2017.

(51) Int. Cl.
*B21D 7/06* (2006.01)
*B21D 7/024* (2006.01)

(52) U.S. Cl.
CPC ..... *B21D 7/063* (2013.01); *B21D 7/024* (2013.01)

(58) Field of Classification Search
CPC ..... B21D 7/02; B21D 7/022; B21D 7/024; B21D 7/04; B21D 7/06; B21D 7/063; B21D 7/066
USPC ..... 72/217; 254/211
See application file for complete search history.

(56) References Cited

U.S. PATENT DOCUMENTS 361,398 A * 4/1887 Daniels ..... B21D 7/022 72/217
1,835,264 A * 12/1931 James ..... B21D 7/063 72/157
2,630,033 A 3/1953 Stover
2,656,747 A * 10/1953 Lewin ..... B21D 7/063 72/459
2,666,351 A * 1/1954 Lewin ..... B21D 7/063 72/459
2,817,986 A 12/1957 Benfield
3,246,498 A 4/1966 Mount
(Continued)

FOREIGN PATENT DOCUMENTS

CN 203842970 9/2014
GB 937810 9/1963
(Continued)

OTHER PUBLICATIONS

International Search Report and Written Opinion for International Application No. PCT/US2018/024020, dated Jul. 5, 2018, 14 pages.
(Continued)

*Primary Examiner* — Adam J Eiseman
*Assistant Examiner* — Matthew Stephens
(74) *Attorney, Agent, or Firm* — Reinhart Boerner Van Deuren s.c.

(57) ABSTRACT

A tool, such as a conduit bender, that includes a gear assembly for providing a mechanical advantage when bending a workpiece conduit. The gear assembly comprises a pinion gear rotatably coupled to a handle, the handle including a pin that can be selectively engaged with the pinion gear. The conduit bender also includes a shoe with teeth that protrude radially inward from a curved outer portion. When the conduit bender is in use, the teeth of the pinion gear engage with the teeth of the shoe.

17 Claims, 11 Drawing Sheets

(56) References Cited

U.S. PATENT DOCUMENTS

| | | | | |
|---|---|---|---|---|
| 3,253,441 | A | 5/1966 | Benfield | |
| 3,336,779 | A | 8/1967 | Schall | |
| 3,590,617 | A | 7/1971 | Mount | |
| 3,718,018 | A | 2/1973 | Benfield | |
| 3,732,721 | A * | 5/1973 | Cusimano | B21F 1/002 72/458 |
| 3,785,190 | A | 1/1974 | Schall et al. | |
| 3,906,778 | A | 9/1975 | Crouse | |
| 4,009,602 | A | 3/1977 | Linguist | |
| 4,196,610 | A | 4/1980 | Chilton | |
| 4,425,784 | A | 1/1984 | D'Gerolamo | |
| 4,442,695 | A | 4/1984 | Gardner | |
| 4,452,064 | A | 6/1984 | Custin | |
| 4,622,837 | A | 11/1986 | Bergman | |
| 5,154,000 | A | 10/1992 | Mahoney et al. | |
| 5,927,141 | A | 7/1999 | Walsten | |
| 6,385,856 | B1 | 5/2002 | Godin | |
| 6,820,457 | B2 | 11/2004 | Luebke et al. | |
| 7,055,362 | B2 | 6/2006 | Widmayer | |
| 7,328,601 | B1 | 2/2008 | King | |
| 7,444,849 | B1 | 11/2008 | Hsueh et al. | |
| 2004/0182129 | A1 | 9/2004 | Hopwood | |
| 2008/0236240 | A1 | 10/2008 | Bates et al. | |
| 2009/0188291 | A1 | 7/2009 | Itrich et al. | |
| 2011/0000273 | A1 | 1/2011 | Latoria | |
| 2015/0033813 | A1 | 2/2015 | Leclerc | |
| 2017/0095849 | A1 | 4/2017 | Nobles | |
| 2018/0272404 | A1 | 9/2018 | Williams et al. | |

FOREIGN PATENT DOCUMENTS

| | | |
|---|---|---|
| GB | 1090383 | 11/1967 |
| GB | 1384582 | 2/1975 |
| WO | WO0071973 | 11/2000 |
| WO | WO2004035244 | 4/2004 |
| WO | WO2013131179 | 9/2013 |
| WO | WO2015184432 | 12/2015 |

OTHER PUBLICATIONS

International Search Report and Written Opinion for International Application No. PCT/US2018/052428, dated Jan. 31, 2019, 15 pages.

* cited by examiner 10
18
66
38
46
118
54
58
138
122
22
50
102
58
98
42
126
126
26
94
98
34
30
74
78

GEARED CONDUIT BENDER

CROSS-REFERENCE TO RELATED PATENT APPLICATIONS

This application is a continuation of International Application No. PCT/US2018/052428, filed Sep. 24, 2018, which claims priority to and the benefit from U.S. Provisional Application No. 62/569,087, filed Oct. 6, 2017, the contents of both of which are incorporated herein by reference in their entireties.

BACKGROUND OF THE INVENTION

The present disclosure relates generally to the field of conduit benders. The present disclosure relates specifically to a geared conduit bender that provides a mechanical advantage when bending a conduit pipe.

Conduit pipes are often used to conceal and protect electrical wiring. To keep the conduit pipes and wiring out of sight, the conduit pipes are often coupled to walls or ceilings. Frequently conduit pipes need to be bent to conform to a desired path, such as to match the contour of a wall or ceiling. Conduit benders, as their name implies, are used to bend the conduit pipes.

SUMMARY OF THE INVENTION

The present disclosure relates to geared conduit benders that provide a mechanical advantage when bending a conduit pipe. In one or more described embodiments, the disclosure relates to a conduit bender with a gear assembly to provide a mechanical advantage. In exchange for the mechanical advantage when bending the conduit pipe, the handle of the conduit bender needs to traverse a correspondingly increased arc distance. For example, if the gear provides a 3:1 mechanical advantage then the handle needs to sweep three times as much distance to bend the conduit pipe to the desired angle.

In some embodiments, a tool, such as a geared conduit bender, comprises a handle with an elongated shaft, a shoe, a link between the two, and a pinion gear. The shoe comprises a curved portion and gear teeth that extends radially inward from a top surface of the curved portion. The link comprises opposing first and second ends along a longitudinal axis, the first end rotatably coupled to the elongated shaft at a first axis of rotation and the second end rotatably coupled to the shoe at a second axis of rotation. The pinion gear is rotatably coupled to the elongated shaft and the first end of the link at the first axis of rotation. The pinion gear rotatably engages with the gear teeth of the shoe to provide a mechanical advantage when bending an elongated workpiece such as a conduit pipe.

In some embodiments, a tool comprises an elongated shaft, a shoe and a gear assembly. The shoe comprises a hook and a curved portion, the curved portion comprising gear teeth protruding radially inward from a top surface of the curved portion. The hook is fixedly coupled to a first end of the curved portion. The gear assembly is rotatably coupled to the elongated shaft and engages with the shoe to provide a mechanical advantage when a user applies force to the elongated shaft to bend the elongated workpiece.

In some embodiments a geared conduit bender comprises an elongated shaft, a link, a shoe and a pinion gear. The link is rotatably coupled to the shaft at a first end of the link. The shoe is rotatably coupled to a second end of the link. The shoe comprises gear teeth that extend radially inward from a top surface of a curved portion. The pinion gear rotatably engages with the gear teeth to provide a mechanical advantage when bending the elongated workpiece.

Additional features and advantages will be set forth in the detailed description which follows, and, in part, will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

DETAILED DESCRIPTION

Figure 1:
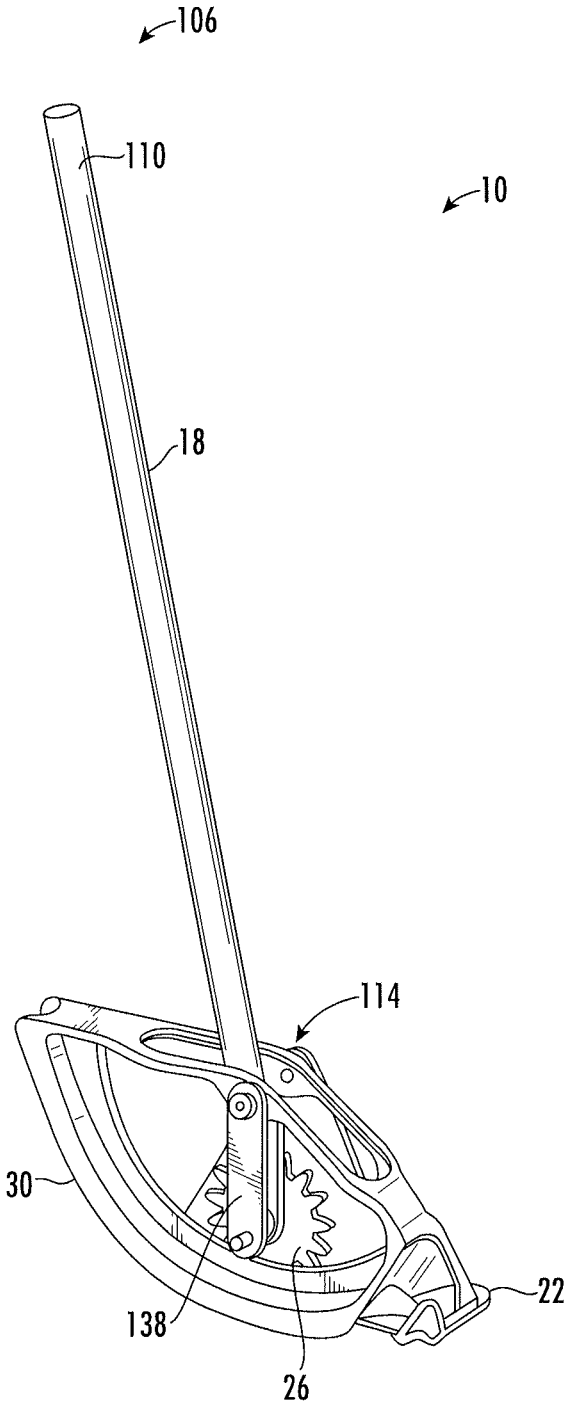
FIG. 1 is a perspective view of a geared conduit bender according to one embodiment.

Referring generally to the figures and below description, various embodiments of a tool for bending an elongated workpiece, such as a conduit bender, are shown and described. Various embodiments of the conduit bender discussed herein include an innovative gear assembly. The gear assembly provides a mechanical advantage when bending a conduit pipe, such as a conduit and/or a conduit run. As a result, less force is required to bend a conduit pipe as compared to bending a conduit using a conventional conduit bender. Additionally, the gear assembly facilitates more precise bending of a conduit pipe because the conduit pipe is bent more slowly in exchange for providing the mechanical advantage. As a result of the conduit pipe bending more slowly, it is easier for the user to stop bending the conduit pipe at a desired angle as compared to bending using a conventional conduit bender.

In one embodiment, the geared conduit bender has a handle, such as an elongated shaft, that is rotatably coupled to a linking component, such as a planar length of metal. The handle and a first end of the linking component are rotatably coupled together at a first axis of rotation. The handle rotates around the first axis of rotation. The second end of the linking component is rotatably coupled to arms of a shoe at a second axis of rotation. The arms extend from first and second ends of a curved portion (e.g., an arc) of the shoe that the conduit pipe is bent around. Gear teeth protrude radially inward from an interior top surface of the curved portion of the shoe (e.g., the teeth protrude or extend generally towards a center of the arc curved portion).

A pinion gear is rotatably coupled to the handle and the first end of the linking component at the first axis of rotation. The teeth of the pinion gear rotatably engage with gear teeth of the curved portion. When the pinion gear is rotated, the pinion gear acts upon the gear teeth of the shoe to cause the shoe to rotate.

In various embodiments, the gear assembly is a sun gear assembly with the pinion gear being the planet gear and the gear teeth of the curved portion being the ring gear that rotates around the pinion gear. The interaction of these gears provides a mechanical force advantage (e.g., as a force multiplier) when applying force to the elongated shaft to bend the elongated workpiece.

In exchange for the gear assembly acting as a force multiplier, the gear assembly bends the conduit pipe a correspondingly reduced amount. As a result, it may be necessary to perform multiple iterations of bending the conduit pipe to achieve a desired angle X of bend in the conduit pipe. In such situations when multiple iterations of bending the conduit pipe are required, a pin in the handle allows the user to disengage the handle from the gear assembly to reposition the handle for further bending of the conduit pipe. The pin protrudes from the handle through a slot in the walls of the handle near the end coupled to the linking component and the pinion gear. The slot extends longitudinally along the handle walls to allow the pin to selectively engage and disengage with the pinion gear. When a user pushes longitudinally down on the handle, the handle pin engages with the pinion gear. Rotation of the handle around the first axis of rotation correspondingly exerts a force on the shoe via the pin acting upon the gear assembly. When a user pulls longitudinally up on the handle, the handle pin disengages from the pinion gear and rotation of the handle around the first axis of rotation does not exert a force on the shoe via the pin. The pin specifically, and handle generally, can be selectively engaged or disengaged from the gear assembly to allow rotation of the handle to bend the conduit pipe.

FIGS. 1-8 illustrate a tool for bending an elongated workpiece, shown specifically as geared conduit bender 10. Geared conduit bender 10 can be used to bend a variety of different conduits pipe such as metal, brass, copper, aluminum, steel, polyvinyl chloride (PVC), etc. In the illustrated embodiment, geared conduit bender 10 is capable of bending a conduit pipe to a desired angle, such as between a range of zero and ninety degrees. In other embodiments, geared conduit bender 10 is capable of bending a conduit pipe greater than ninety degrees. Geared conduit bender 10 includes handle 18, shoe 30, base 22, and pinion gear 26.

In one embodiment, a user manipulates handle 18 to selectively engage with pinion gear 26 to bend conduit pipe 14. In one embodiment, handle 18 is a generally cylindrical, elongated rigid component (e.g., a rigid length of metal material) and includes first end 106 with bend adjuster 110 and second end 114 opposite first end 106 that couples to connector 118. Both second end 114 and connecter 118 are positioned within elongated slot 94 on arm 66 of shoe 30. Connector 118 includes base portion 122 and two prongs 126. Base portion 122 receives second end 114 of handle 18 and includes two slots 130 opposite each other. Pin 134 extends from handle 18 through slots 130 to secure handle 18 to connector 118.

By selectively interacting with pinion gear 26, as described below, a user of geared conduit bender 10 is provided a mechanical advantage when bending conduit pipe 14. Pinion gear 26 is rotatably coupled to shaft 102 and second flange 38 via fastener 58 at first axis of rotation 50 (best shown in FIGS. 2-3). Pinion gear 26 rotates relative to base 22 about first axis of rotation 50. Pinion gear 26 rotatably engages with rack 86 of shoe 30 via the plurality of gear teeth 28 on pinion gear 26 interlocking with the plurality of gear teeth 90 on rack 86 so that when pinion gear 26 is rotated about first axis of rotation 50, shoe 30 is rotated about second axis of rotation 54.

Shoe 30 rotates about second axis of rotation 54 relative to base 22. Shoe 30 is rotatably coupled to second aperture 46 with fastener 58 (e.g., a bolt and nut). Shoe 30 includes curved bottom portion 62 and arm 66. Channel 74 is configured to partially secure conduit pipe 14 as shoe 30 is rotated about second axis of rotation 54. Channel 74 extends along bottom side (e.g., periphery) 70 of curved bottom portion 62 opposite gear teeth 90. In various embodiments, channel 74 is sized to fit a conduit with a diameter within the range of 0.5 inches and three inches. In further embodiments, channel 74 is sized to fit any diameter of conduit. Channel 74 includes hook 78 that is fixedly coupled to one end of curved bottom portion 62 and that holds conduit pipe 14 against channel 74 as shoe 30 is rotated to bend conduit pipe 14. On a top side 82 of bottom portion 62 is curved rack 86 (FIG. 7) with a plurality of gear teeth 90 that correspond to a plurality of gear teeth 28 on the pinion 26.

Figures 2, 8:
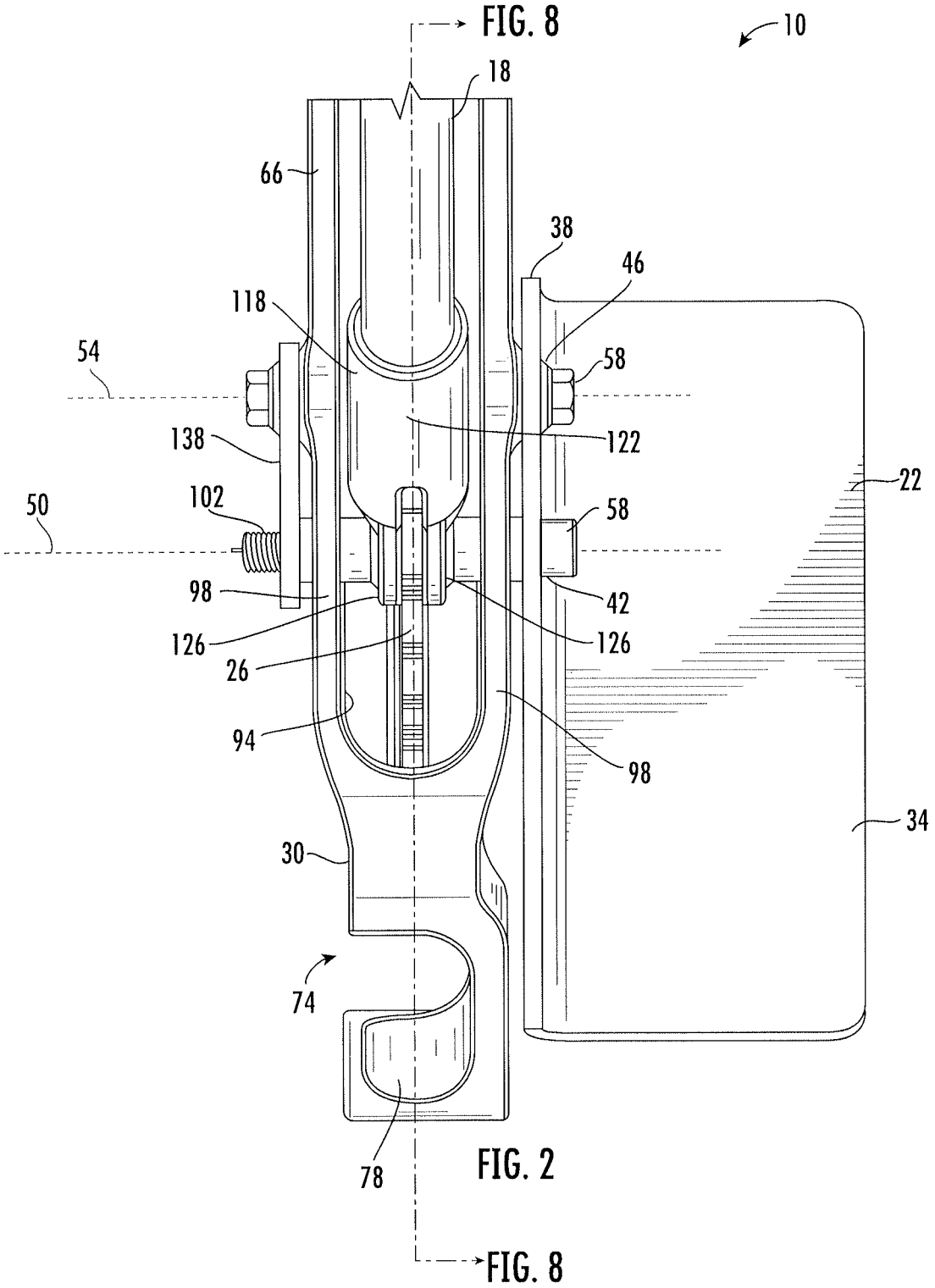
FIG. 2 is a top view of the geared conduit bender of FIG. 1.
FIG. 8 is a cross-sectional view of a geared conduit bender of FIG. 2 with a pin disengaged from a pinion.
Figure 3:
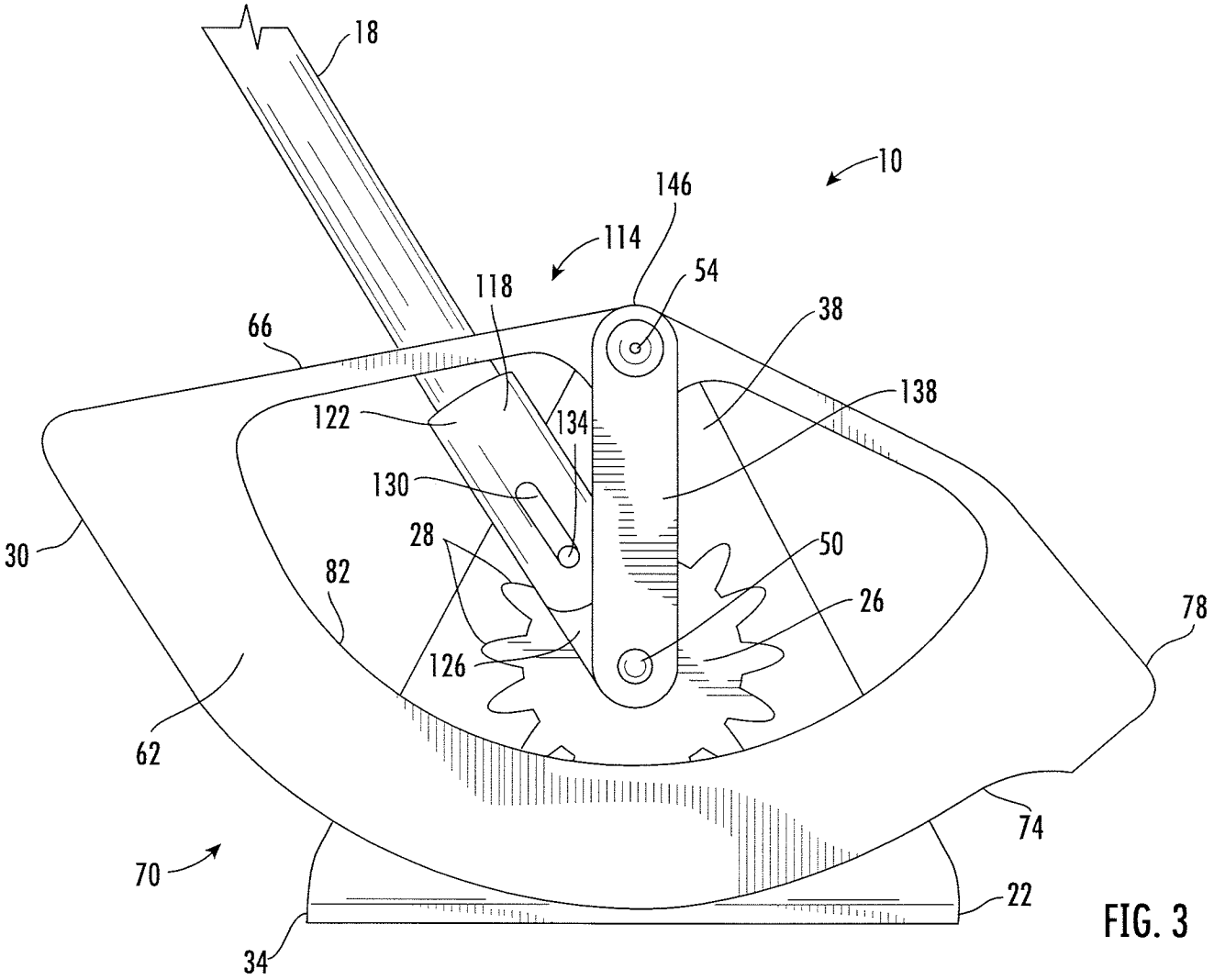
FIG. 3 is a side view of the geared conduit bender of FIG. 1.

With reference to FIGS. 2 and 3, base 22 provides leverage for a user against a surface, such as the floor, when manipulating conduit bender 10. Base 22 comprises first flange 34 that is configured to be positioned on a floor or a surface when bending conduit pipe 14, and triangular second flange 38. In various embodiments, first flange 34 is secured to the floor using fasteners (bolts, nails, screws, etc.) through apertures 154 (best shown in FIG. 9). Base 22 further includes first aperture 42 that defines first axis of rotation 50 and second aperture 46 that defines second axis of rotation 54. First aperture 42 is generally positioned in the middle of second flange 38 and second aperture 46 is generally positioned in the upper-most point of second flange 38.

Figure 6:
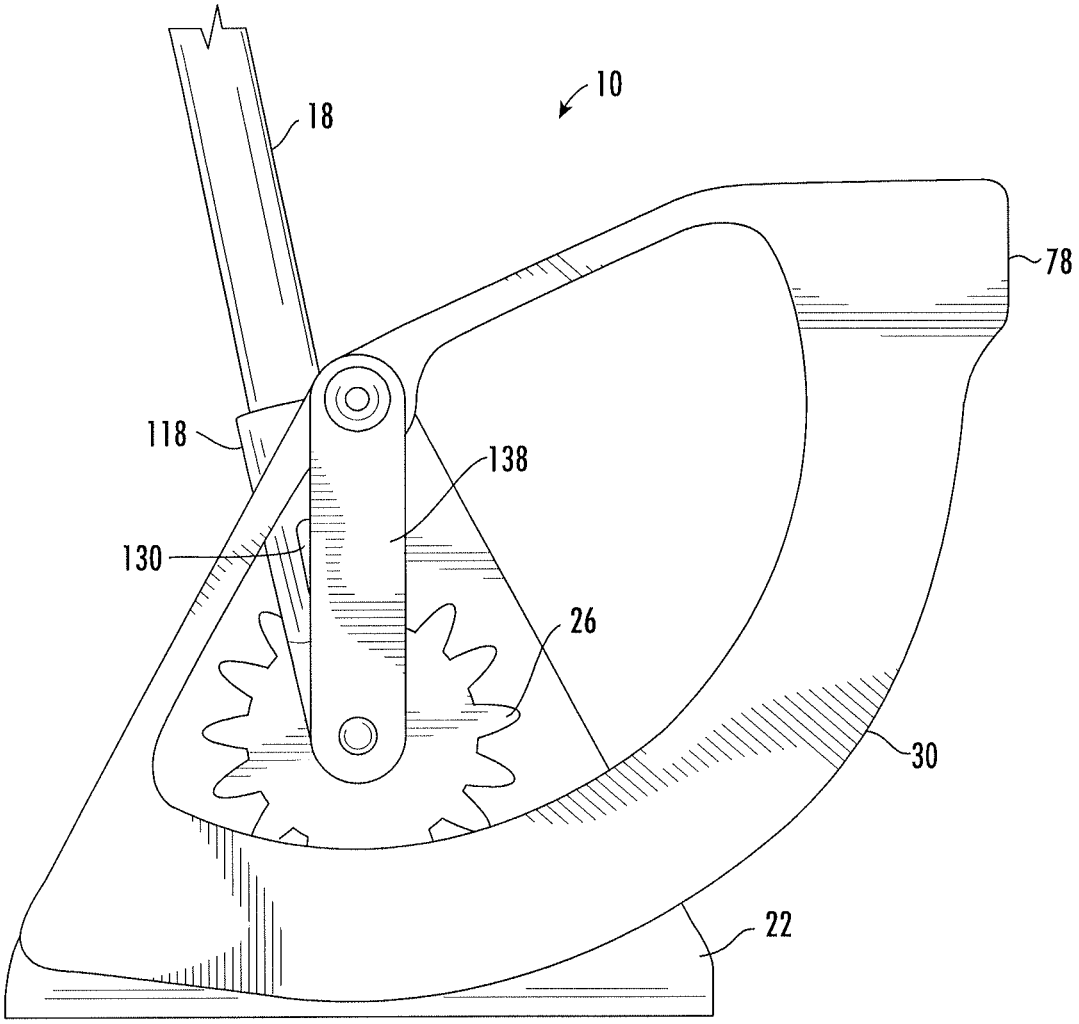
FIG. 6 is a side view of the geared conduit bender of FIG. 1 in a second position.
Figure 7:
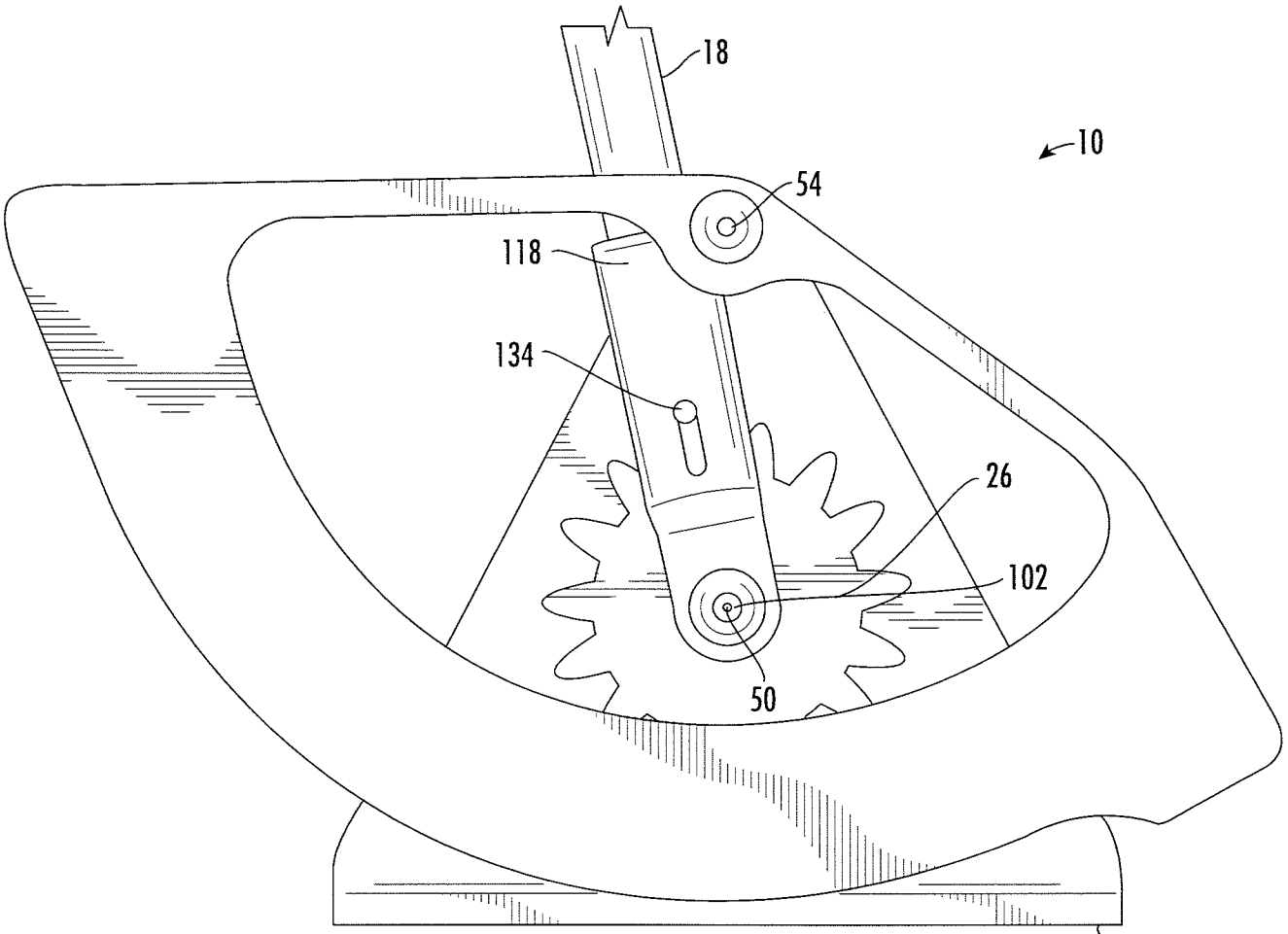
FIG. 7 is a side view of the geared conduit bender of FIG. 1 with a pin disengaged from a pinion.
Figure 8:
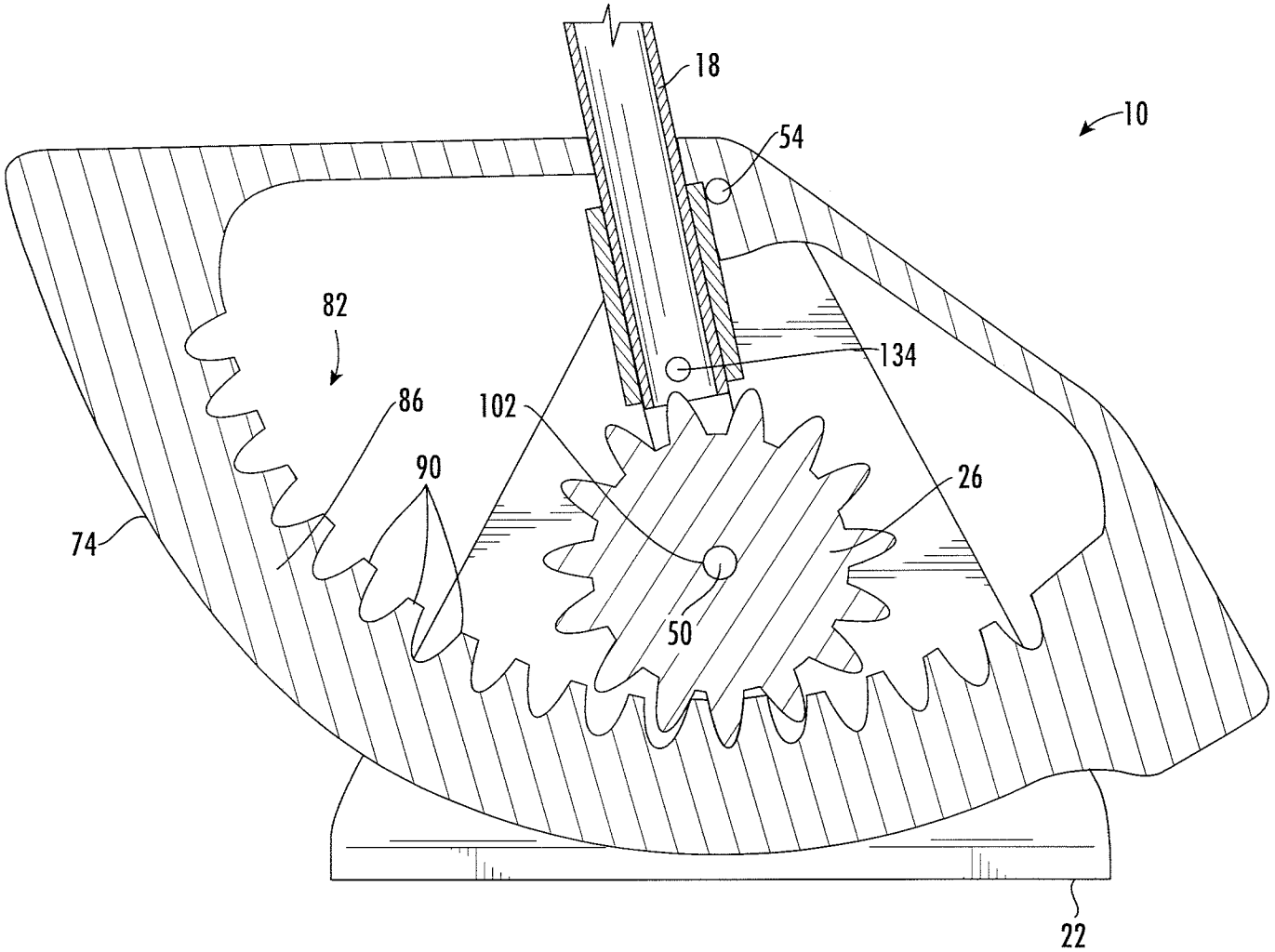

In use, handle 18 can be manipulated to selective engage with pinion gear 26 by handle 18 moving to a position where pin 134 engages pinion gear 26 (FIG. 3) or a position where pin 134 does not engage gear tooth 28 on pinion gear 26 (FIGS. 6 and 7). Curved rack 86 protrudes radially inward from top side 82 of curved bottom portion 62 (FIG. 7) with a plurality of gear teeth 28 that engage plurality of gear teeth 28 on pinion gear 26. Arms 66 of shoe 30 define elongated slot 94 between two bridges 98 of arms 66. In use, handle 18 is rotated around first axis of rotation 50 through elongated slot 94.

In the illustrated embodiment, rack 86 is an integral part of shoe 30. In other embodiments, rack 86 may be a separate piece coupled to shoe 30. In further embodiments, rack 86 may not be centered on shoe 30.

As shown in FIGS. 1-3, pinion 26 is positioned on shaft 102 that is coupled to first aperture 42 of second flange 38 with fastener 58. Pinion 26 rotates relative to base 22 about first axis of rotation 50. Pinion 26 is also positioned on rack 86 of shoe 30 with the plurality of gear teeth 28 on pinion 26 interlocking with the plurality of gear teeth 90 on rack 86 so that when pinion 26 is rotated about first axis of rotation 50, shoe 30 is rotated about second axis of rotation 54.

With reference to FIGS. 1-3, in various embodiments handle 18 is generally cylindrical and includes first end 106 with bend adjuster 110 and second end 114 opposite first end 106 that couples to connector 118. Both second end 114 of handle 18 and connecter 118 are positioned within elongated slot 94 on top portion 66 of shoe 30. Connector 118 includes base portion 122 and two prongs 126. Base portion 122 receives second end 114 of handle 18 and includes two slots 130 opposite each other. Pin 134 extends through slots 130 and handle 18 to secure handle 18 to connector 118. Handle 18 can be moved within slots 130 to a position where pin 134 engages gear tooth 28 on pinion 26 (FIG. 3) or a position where pin 134 does not engage gear tooth 28 on pinion 26 (FIGS. 6 and 7).

Two prongs 126 protrude from connector 118 and include apertures (not shown) that are positioned on shaft 102 along first axis of rotation 50. Two prongs 126 surround pinion gear 26 on both sides and can rotate relative to pinion gear 26 when pin 134 is not engaged in gear teeth 28 of pinion gear 26. As such, connector 118 is rotatable about first axis of rotation 50. Link 138 is coupled to shaft 102 and arm 66 of shoe 30 to adjust the arrangement of geared conduit bender 10. One end 142 of link 138 is opposite end 146 along a longitudinal axis of link 138. Link 138 is rotatably coupled at one end 142 to shaft 102 about first axis of rotation 50 and at another end 146 to base 22 about second axis of rotation 54. Link 138 prevents pinion gear 26 and connector 118 from rotating out of alignment with first axis of rotation 50 and shoe 30 from rotating out of alignment with second axis of rotation 54.

Figure 4:
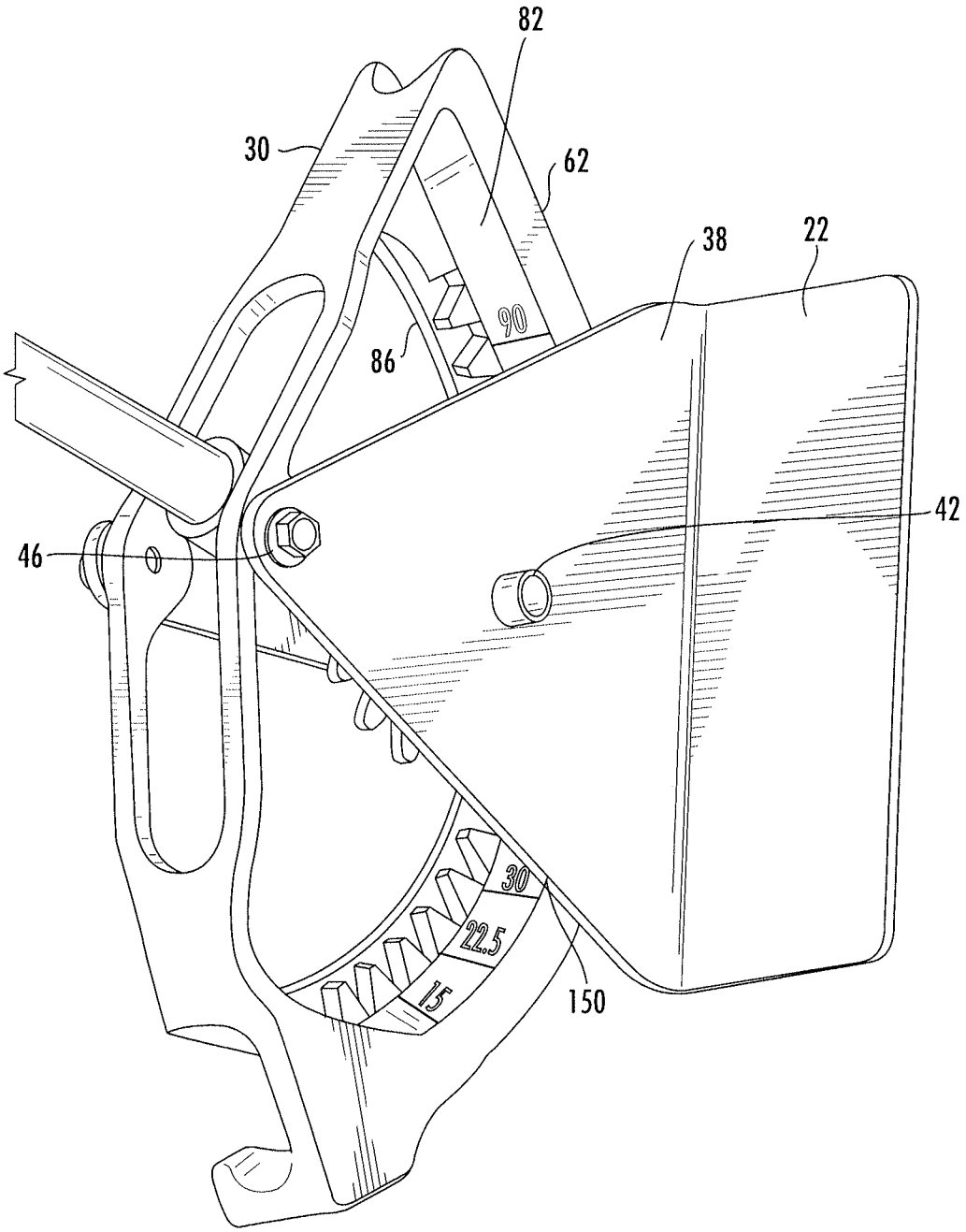
FIG. 4 is a perspective view of the geared conduit bender of FIG. 1 detailing a scale.

As shown in FIG. 4, second flange 38 of base 22 can be used as an angle indicator 150 to indicate the angle that conduit pipe 14 has been bent. Top side 82 of curved bottom portion 62 of shoe 30 includes a scale with markings spaced along top side 82 of shoe 30 adjacent rack 86. The markings indicate the angle conduit pipe 14 has been bent. During operation of geared conduit bender 10, whichever marking aligns with angle indicator 150 is the angle that conduit pipe 14 has been bent. The scale allows for the angle to reference something other than the ground. The scale is also relatively close to angle indicator 150 lowering the chances of mistaken angle readings.

Figure 5:
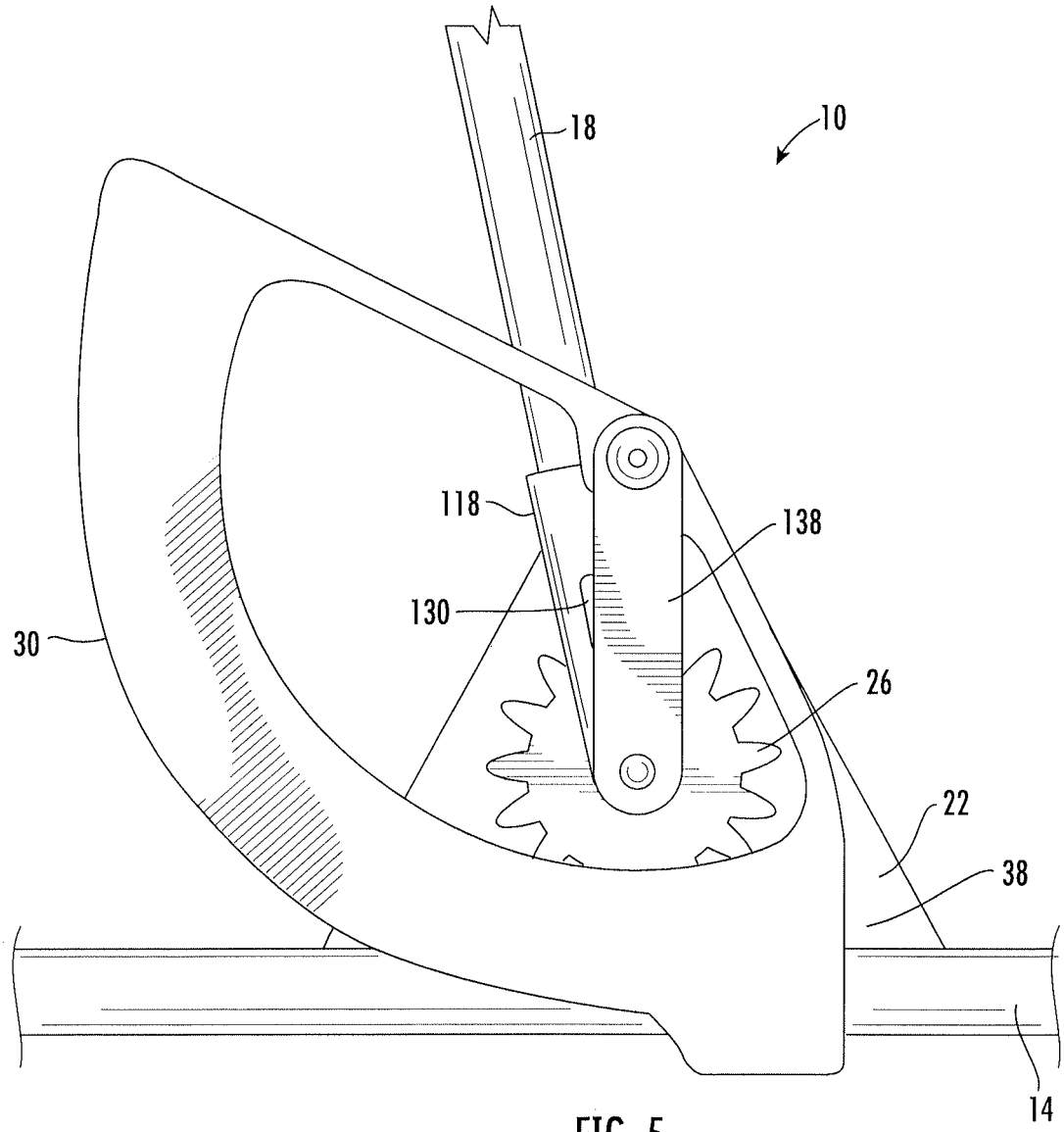
FIG. 5 is a side view of the geared conduit bender of FIG. 1 in a first position.

In the illustrated embodiment, geared conduit bender 10 is capable of bending conduit pipe 14, such as by up to ninety degrees. Geared conduit bender 10 can be rotated between a starting position (FIG. 4) and a ninety degree bend position (FIG. 5). During operation, geared conduit bender 10 begins in the starting position. In the starting position, first flange 34 of base 22 is flush with the ground or surface leaving a clearance between channel 74 of shoe 30 and the ground. Conduit pipe 14 is inserted into channel 74, with the intended spot of the bend positioned in hook 78. To begin bending of conduit pipe 14, a user engages pin 134 with gear teeth 28 on pinion gear 26. The user subsequently rotates handle 18 counter-clockwise (as viewed from FIG. 4) and pinion gear 26 about second axis of rotation 54 causes shoe 30 to rotate counter-clockwise, thus bending conduit pipe 14. In the illustrated embodiment, the rotation of handle 18 is limited to the size of elongated slot 94 in shoe 30. A full sweep of handle 18 is complete when handle 18 rotates the entire length of elongated slot 94.

Geared conduit bender 10 provides a mechanical force advantage (e.g., as a force multiplier) when applying force to the elongated shaft to bend the elongated workpiece. In the illustrated embodiment, geared conduit bender 10 provides a 3.5 to 1 force reduction. In other words, if a user applies a force of X to handle 18, a force of 3.5 times X is exerted on conduit pipe 14 by shoe 30. The force multiplier requires handle 18 to rotate a correspondingly further distance in order to bend conduit pipe 14 to arbitrary angle X (e.g., to an angle of 90 degrees). Handle 18 rotates within elongated slot 94. In the illustrated embodiment, approximately three sweeps are required to bend conduit pipe 14 ninety degrees. In other embodiments, geared conduit bender 10 can provide a greater or lesser force multipliers requiring greater or fewer sweeps in order to bend conduit pipe 14 to angle X. In other embodiments, the mechanical force advantage provided by geared conduit bender 10 is between a range of 3:1 and 4:1, and in still other embodiments the mechanical force advantage provided by geared conduit bender 10 is between a range of 2:1 and 5:1.

As shown in FIGS. 6 and 7, pin 134 is disengaged from pinion gear 26 allowing a user to freely rotate handle 18 within elongated slot 94 about first axis of rotation 50. To disengage pin 134 from pinon gear 26, a user pulls upward on handle 18. With pin 134 disengaged, a user can relocate handle 18 within elongated slot 94. Meanwhile, pinion gear 26 and conduit pipe 14 prevent shoe 30 from rotating while handle 18 is disengaged from pinion gear 26. To reengage pin 134 to pinion gear 26, a user pushes handle 18 down so that pin 134 engages on pinion gear 26, thus allowing the user to complete another sweep. A user can repeat this process until conduit pipe 14 is bent to a desired angle.

Figure 9:
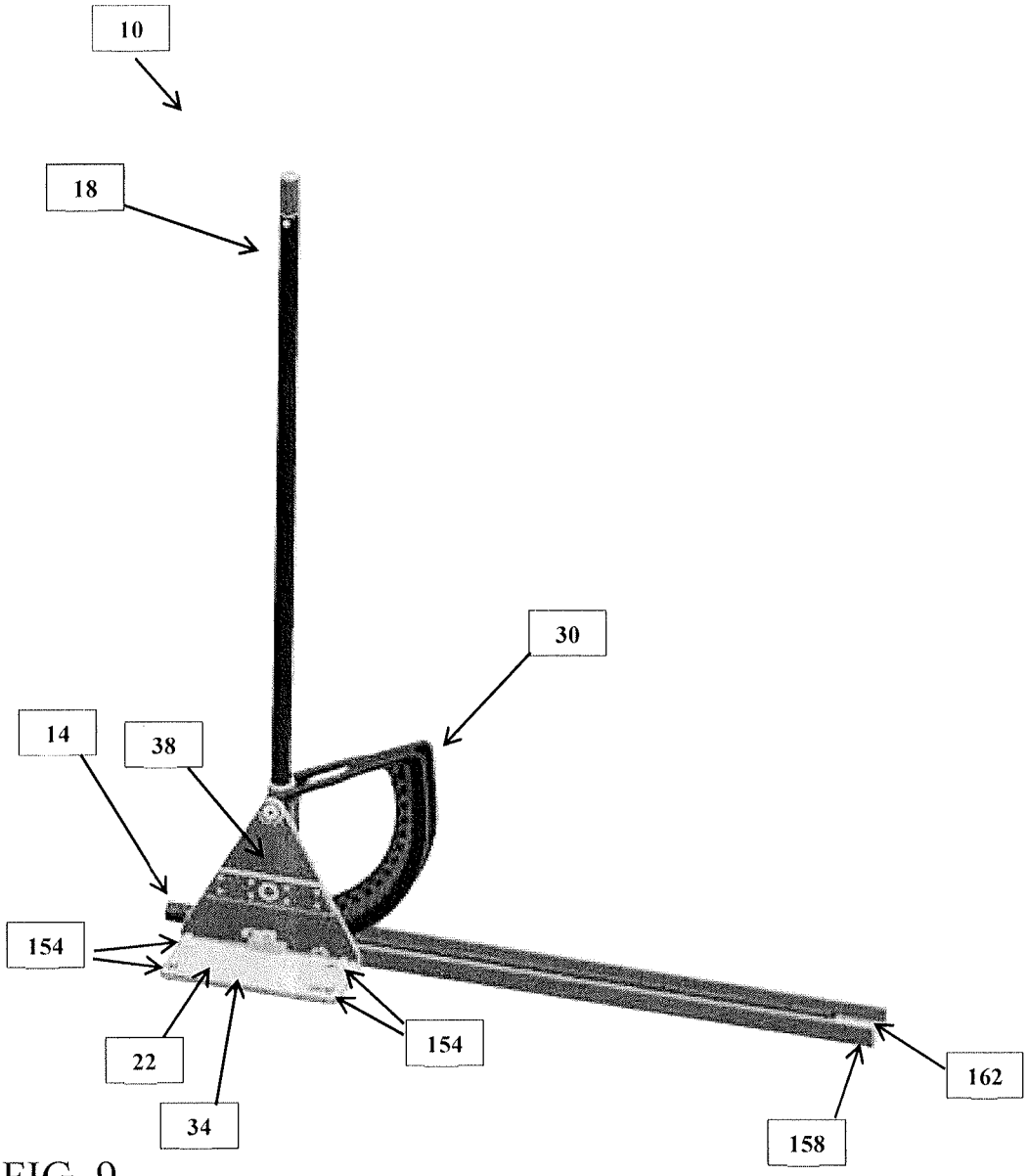
FIG. 9 is a perspective side view of a geared conduit bender, according to an embodiment.
Figure 10:
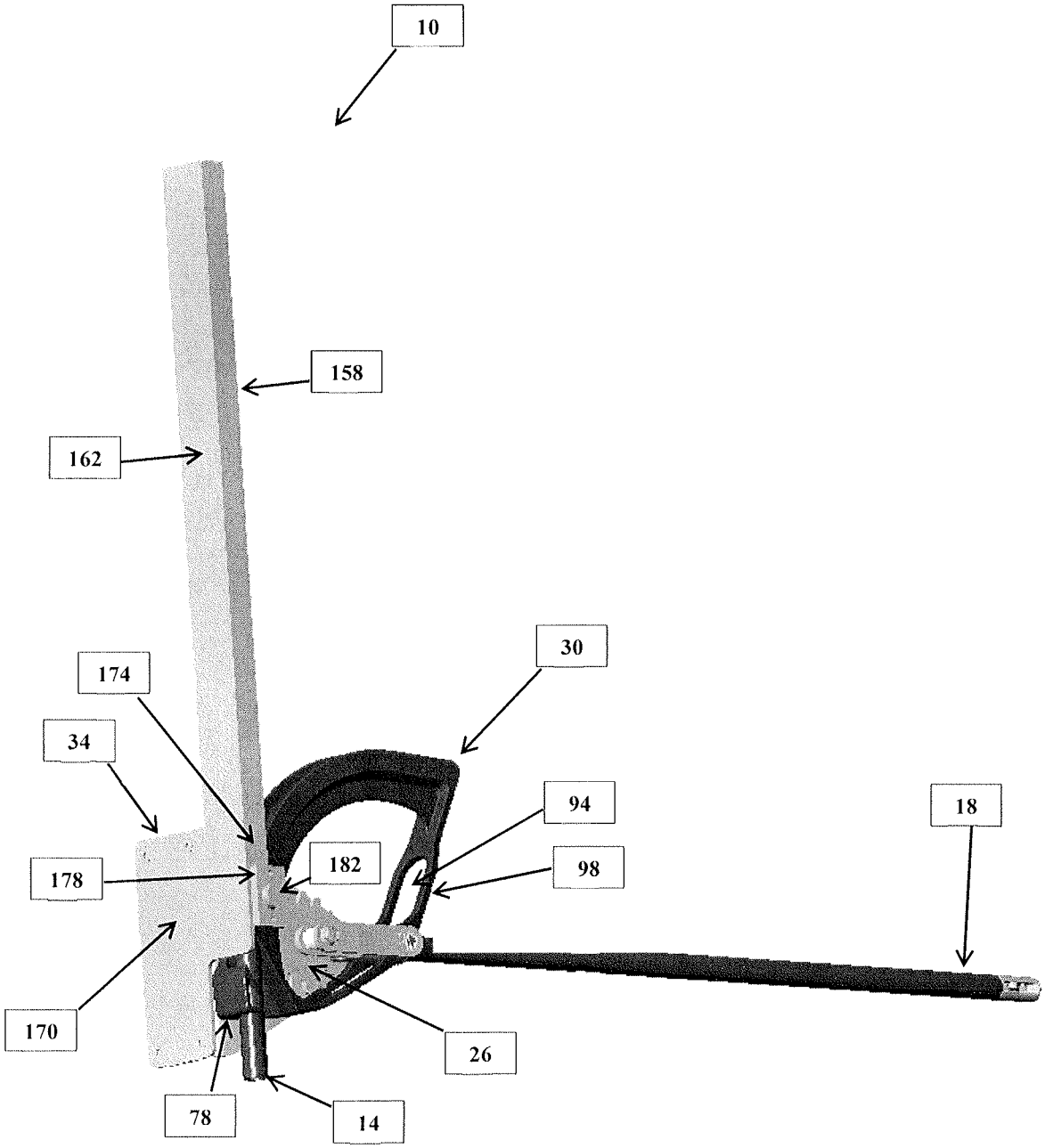
FIG. 10 is a perspective bottom view of the geared conduit bender of the embodiment of FIG. 9.
Figure 11:
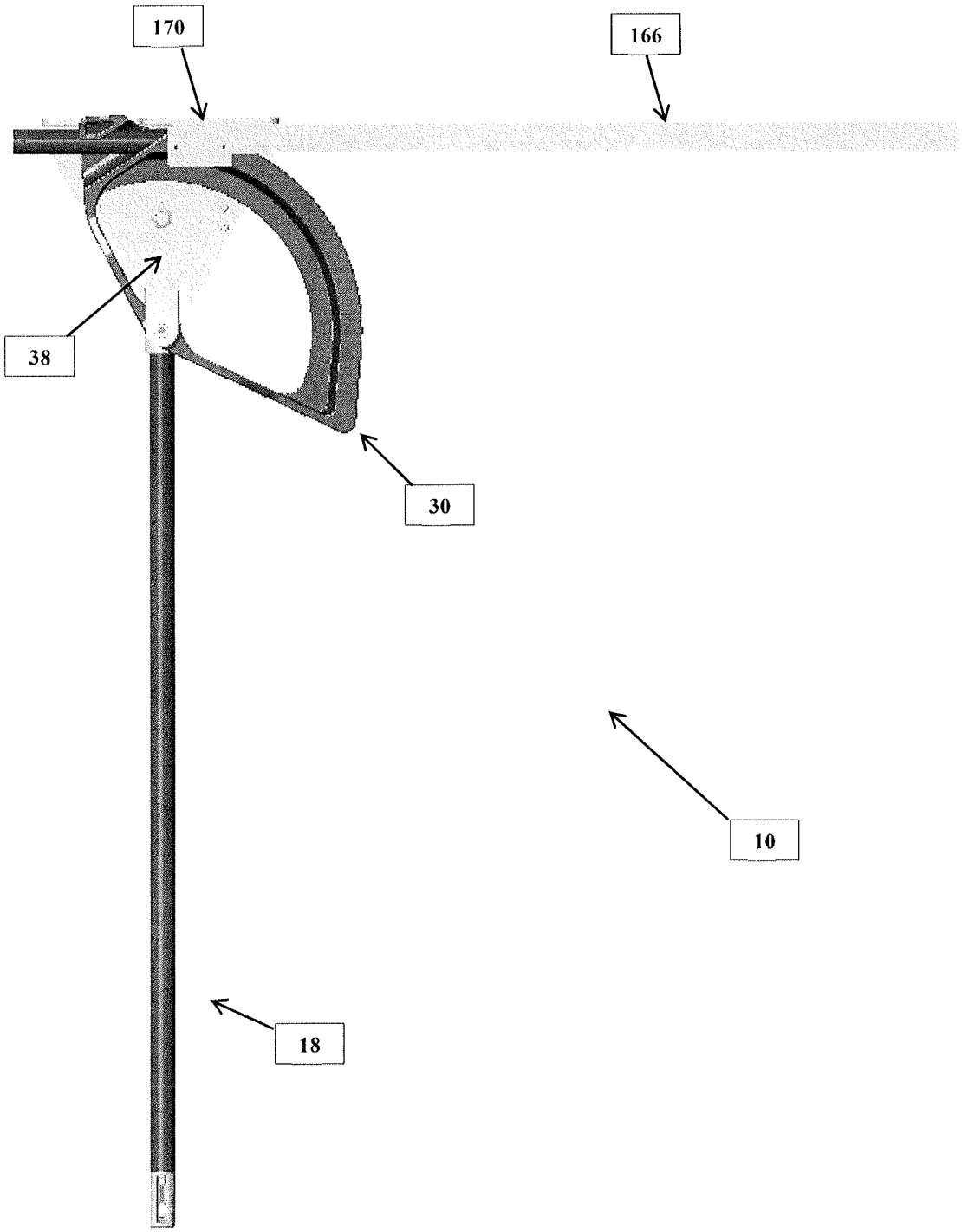
FIG. 11 is a side view of a geared conduit bender of the embodiment of FIG. 9.

With reference to FIGS. 9-11, reaction arm 158 provides leverage for a user against a surface, such as the floor, when manipulating conduit bender 10. Reaction arm 158 defines channel 162 in which conduit pipe 14 is placed when being bent. Reaction arm 158 provides a counter-force so that the user may more easily pull handle 18 to bend conduit pipe 14 without the user having to force first flange 34 to the ground. Reaction arm 158 extends from first flange 34 away from hook 78. In use, as hook 78 pulls conduit pipe 14 while conduit pipe 14 is being bent, hook 78 moves away from reaction arm 158 (best shown FIG. 10).

In one embodiment, reaction arm 158 is secured to sidewall 174, which extends perpendicularly from first flange 34 of base 22. Reaction arm 158 and sidewall 174 are secured together via a fastener 182 extending through reaction arm 158, sidewall 174 and securing plate 178. Bottom surface 166 of reaction arm 158 is generally parallel to and slightly elevated from bottom surface 170 of first flange 34 (best shown in FIG. 11). In various other embodiments, bottom surface 166 of reaction arm 158 is generally coplanar to bottom surface 170 of first flange 34 (not shown).

As shown in FIGS. 9-11, reaction arm 158 is open-ended such that conduit pipe 14 may be lowered into reaction arm 158. In other embodiments, not shown, reaction arm 158 is a pipe, and thus conduit pipe 14 is inserted axially into reaction arm 148.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner.

Various embodiments of the invention relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

What is claimed is:

1. A tool for bending an elongated workpiece, the tool comprising:

an elongated shaft;

a shoe comprising an arc around which the elongated workpiece is bent and a top portion configured to surround on all sides and receive the elongated shaft;

gear teeth extending radially from an interior surface of the arc;

a link with opposing first and second ends along a longitudinal axis, the first end rotatably coupled to the elongated shaft at a first axis of rotation and the second end rotatably coupled to the shoe at a second axis of rotation; and a pinion gear rotatably coupled to the elongated shaft and the first end of the link at the first axis of rotation, the pinion gear rotatably engaging with the gear teeth to provide a mechanical force advantage when bending the elongated workpiece.

2. The tool of claim 1, the elongated shaft comprising a pin that protrudes from the elongated shaft, the pin configured to selectively engage with the pinion gear.

3. The tool of claim 1, the arc comprising a channel on a bottom periphery of the shoe opposite the gear teeth, the channel configured to receive the elongated workpiece.

4. The tool of claim 3, the arc comprising a hook fixedly coupled to the shoe at a first end of the arc.

5. The tool of claim 4, the top portion of the shoe comprising arms that extend from the first end of the arc to a second end of the arc, the shoe rotatably coupled to the link via the arms.

6. The tool of claim 5, the arms defining an elongated slot through which the elongated shaft is rotated, the elongated slot positioned between a first exterior top surface extending continuously from the first end of the arc and a second exterior top surface extending continuously from the second end of the arc.

7. The tool of claim 6, the elongated shaft comprising a pin that protrudes from the elongated shaft, the pin configured to selectively engage with the pinion gear.

8. The tool of claim 1, further comprising a base rotatably coupled to the shoe at the second axis of rotation, the base comprising a flange and a plate, the plate configured to be positioned on a floor or surface when the elongated workpiece is being bent.

9. The tool of claim 4, further comprising a base rotatably coupled to the shoe at the second axis of rotation, the base comprising a flange and a reaction arm configured to receive the elongated workpiece while the elongated workpiece is being bent, the reaction arm extending away from the shoe at a first end of the arc.

10. The tool of claim 1, the mechanical force advantage being between the range of 3:1 and 4:1.

11. A tool for bending an elongated workpiece, the tool comprising:

an elongated shaft;

a shoe comprising a hook, a top portion and a curved portion, the top portion coupled to the curved portion and configured to receive and enclose the elongated shaft, the curved portion comprising gear teeth protruding radially inward from a top surface of the curved portion, the hook fixedly coupled to a first end of the curved portion; and a gear assembly rotatably coupled to the elongated shaft, the gear assembly engaging with the shoe.

12. The tool of claim 11, the gear assembly comprising:

a pinion gear rotatably coupled to the elongated shaft at a first axis of rotation, the pinion gear rotatably engaging with the gear teeth of the shoe.

13. The tool of claim 12, the elongated shaft comprising a pin that protrudes from the elongated shaft and is configured to selectively engage with the pinion gear.

14. The tool of claim 12, the tool comprising a link that is rotatably coupled to the pinion gear and the elongated shaft at the first axis of rotation, the link being further rotatably coupled to the shoe at a second axis of rotation.

15. The tool of claim 13, the top portion of the shoe comprising arms that extend from the first end of the curved portion to a second end of the curved portion and define an elongated slot through which the elongated shaft is rotated, wherein the elongated shaft is enclosed within the elongated slot.

16. The tool of claim 11, the curved portion comprising a channel on the outer periphery of the curved portion configured to receive the elongated workpiece.

17. The tool of claim 11, further comprising a base rotatably secured to the elongated shaft, the base comprising a flange and a plate, the plate configured to be positioned on a floor or surface when the elongated workpiece is being bent.

* * * * *